US005320088A

United States Patent [19]

Nester

[11] Patent Number: 5,320,088

[45] Date of Patent: Jun. 14, 1994

[54] VENTILATOR ASSEMBLY AND METHOD OF REMOVING KITCHEN EXHAUST FUMES

[75] Inventor: F. Brent Nester, Monroe, N.C.

[73] Assignee: Aerolator Systems, Inc., Monroe, N.C.

[21] Appl. No.: 85,391

[22] Filed: Jun. 30, 1993

[51] Int. Cl.[5] ..... F24C 15/20

[52] U.S. Cl. ..... 126/299 D; 126/299 R

[58] Field of Search ..... 126/299 D, 299 R

[56] References Cited

U.S. PATENT DOCUMENTS

| | | | |
|---|---|---|---|
| D. 300,557 | 4/1989 | Breidinger | D23/387 |
| D. 309,659 | 7/1990 | Welsh | D23/387 |
| 4,200,087 | 4/1980 | Welsh | 126/299 R |
| 4,501,260 | 2/1985 | Grace | 126/299 R |
| 4,738,243 | 4/1988 | Welsh et al. | 126/299 R |
| 4,738,244 | 4/1988 | Welsh | 126/299 R |

*Primary Examiner*—Carroll B. Dority

*Attorney, Agent, or Firm*—W. Thad Adams, III

[57] ABSTRACT

The invention relates to a ventilator assembly and method for removing kitchen exhaust fumes entrained in a moving air stream from an area surrounding a cooking unit. A roof-top blower moves the air stream from the cooking area through an air duct to the atmosphere. An overhanging hood defines a ventilation opening located above the cooking unit. One or more air vents are formed in a top wall of the hood and communicate with the air duct. A detachable high velocity module is positioned in the hood in filtering relation to the air vents. The high velocity module includes opposing side plates, a filter housing connected to the side plates, and an inclined exhaust baffle located between the filter housing and the cooking unit. The exhaust baffle defines at least one laterally extending slot formed therein for accelerating the flow of the moving air stream into the high velocity module. One or more grease filters are mounted in the filter housing for removing fumes from the moving air stream.

19 Claims, 7 Drawing Sheets

VENTILATOR ASSEMBLY AND METHOD OF REMOVING KITCHEN EXHAUST FUMES

TECHNICAL FIELD AND BACKGROUND OF THE INVENTION

The invention relates to a ventilator assembly, and a method for removing exhaust fumes from an area surrounding a cooking unit, particularly such as used in restaurants and other commercial food preparation areas. Such assemblies are known in the art, and typically include a ventilation hood located above the cooking unit and attached to a wall of the kitchen. A typical prior art assembly includes a roof-top or outside blower in communication with the hood to pull air from the cooking area to the outside. Kitchen exhaust fumes generated by the cooking unit and entrained in the air stream are pulled upwardly through the ventilation opening. One or more filters are generally located in the hood for filtering the exhaust fumes from the surrounding air stream as the air stream is passed through the ventilation opening of the hood to the atmosphere.

A ventilator assembly of the present invention is particularly suited for use in a fast-food restaurant where food is prepared in large quantities on an open fry or grill surface or in a deep fryer. This method of cooking produces grease-contaminated exhaust fumes which must be moved upwardly away from the cooking area. Once removed from the cooking area, the fumes are captured, and the filtered air stream is dispersed into the atmosphere outside of the restaurant.

Prior art ventilator assemblies are subject to numerous disadvantages. Some prior hoods have been designed to remove a relatively large amount of air from the cooking area to ensure removal of the entrained exhaust fumes. While this procedure may be adequate for removing fumes, it is not cost effective since both fumes and conditioned air in the air stream are being simultaneously withdrawn from the kitchen area. This leads to increased heating and cooling expenses, as well as increased blower energy requirements. Typically, such hoods further include provisions for resupplying conditioned air to the kitchen area.

Other prior art hoods have attempted to resolve this problem by providing a plate or baffle located in the ventilation opening of the hood. The plate has several openings for accelerating the air flow. These hoods typically include several components which must be assembled and positioned within the hood for directing and filtering air flow through the hood. The filters, attached behind the plates, are often difficult to insert and remove. Moreover, a significant amount of conditioned air is still being removed from the kitchen area. Although this type of hood requires less air removal from the kitchen area by accelerating air flow into the hood, it is nevertheless inadequate as compared to the present invention.

The present invention is both cost and performance effective. It requires that only a minimal quantity of conditioned air removed from the kitchen area, while removing a substantial amount of fumes. Air flow is more effectively accelerated and directed through the ventilation opening and filtered. By pulling the air stream through spaced-apart slots and then directing the air through the filter, less blower energy is needed for fume removal. Thus, less conditioned air is wasted to the atmosphere.

Furthermore, the present invention includes a modular element which is conveniently inserted into and removed from the ventilation opening in a single unit. Unlike the prior art, there are no elements which must be suspended and mounted within the hood. The high velocity module of the present invention includes a filter housing for allowing easy replacement of filters.

SUMMARY OF THE INVENTION

Therefore, it is an object of the invention to provide a ventilator assembly located above a cooking unit which effectively and efficiently removing kitchen exhaust fumes from an area surrounding the cooking unit.

It is another object of the invention to provide a ventilator assembly which cooperates with a roof-top blower to pull air from the cooking unit area and discharge the air to the atmosphere.

It is another object of the invention to provide a ventilator assembly which includes an overhanging hood located above the cooking unit for defining a ventilation opening in communication with the blower.

It is another object of the invention to provide a ventilator assembly which includes a removable high velocity module positioned within the ventilation opening for increasing the velocity of air flow into the high velocity module, and for filtering the air as it exits the high velocity module.

It is another object of the invention to provide a ventilator assembly which includes a removable high velocity module comprising a baffle for accelerating air flow and a filter, each contained in a single, modular structure.

It is another object of the invention to provide a ventilator assembly which can be constructed to accommodate any given sized cooking unit.

It is another object of the invention to provide a ventilator assembly which is cost effective, requiring less conditioned air to be removed from the kitchen area, while maintaining a high rate of exhaust removal.

It is another object of the invention to provide a ventilator assembly that does not require make-up air to be introduced into the kitchen area due to a high level of air removed from the kitchen area.

It is another object of the invention to provide a ventilator assembly which includes a grease tray located below the high velocity module for capturing grease filtered out by the high velocity module.

It is another object of the invention to provide a ventilator assembly which includes a detachable grease cup located beneath one end of the grease tray for collecting grease drained from the grease tray.

It is another object of the invention to provide a ventilator assembly which includes a flue gas by-pass for gas powered cooking units to simultaneously remove flue gas and fumes from the cooking area.

These and other objects of the present invention are achieved in the preferred embodiments disclosed below by providing a ventilator assembly for removing kitchen exhaust fumes entrained in a moving air stream from an area surrounding a cooking unit. A roof-top blower moves the air stream from the cooking area through an air duct to the atmosphere.

The ventilator assembly includes an overhanging hood defining a ventilation opening located above the cooking unit. The hood includes a back wall, an outwardly extending top wall, a front wall, and spaced-apart opposing side walls. One or more air vents are formed in the top wall of the hood and communicate with the air duct.

A detachable high velocity module is positioned in the hood in filtering relation to the air vents. The high velocity module includes opposing side plates, a filter housing connected to the side plates, and an inclined exhaust baffle located between the filter housing and the cooking unit. The exhaust baffle is positioned in the ventilation opening of the hood and extends inwardly and downwardly in a diagonal line from the front wall of the hood to the back wall of the hood. The exhaust baffle defines at least one laterally extending slot formed therein for accelerating the flow of the moving air stream into the high velocity module. One or more grease filters are mounted in the filter housing for removing fumes from the moving air stream as the fumes are pulled upwardly in the air stream by the roof-top blower, away from the cooking area, and through the high velocity module from an upstream side to an downstream side thereof.

According to one preferred embodiment of the invention, the back wall includes a support ledge connected thereon for supporting a back end of the high velocity module. The front wall includes an inwardly extending shelf connected thereto for supporting a front end of the high velocity module.

According to another preferred embodiment of the invention, the filter housing of the high velocity module includes a base plate extending from a back edge of the baffle at an obtuse angle with respect to the baffle. The base plate is designed for carrying the filter and for engaging the support ledge of the back wall.

According to yet another preferred embodiment of the invention, the high velocity module further includes a top plate connected to the side plates for extending in a substantially horizontal plane opposite the baffle. The top plate has a support lip connected thereto extending beyond the front end of the high velocity module for engaging the self of the front wall.

According to yet another preferred embodiment of the invention, the filter is mounted on the base plate of the filter housing and extends upwardly and outwardly in a diagonal line to a back edge of the top plate.

According to yet another preferred embodiment of the invention, the top plate and a front edge of the baffle define a slot formed therebetween extending from one side plate to the other side plate for accelerating air flow into-the high velocity module.

According to yet another preferred embodiment of the invention, the filter includes a plurality of weep holes formed in the base thereof for allowing filtered grease to weep out of the filter.

According to yet another preferred embodiment of the invention, the back edge of the baffle and the base plate are integrally formed. A plurality of weep holes are formed at the connection substantially corresponding to and in cooperation with the weep holes of the filter for allowing the grease from the filter to weep out of the high velocity module.

According to yet another preferred embodiment of the invention, at least one handle is connected to an exterior face of the baffle for allowing the high velocity module to be easily inserted into and detached from the hood.

According to yet another preferred embodiment of the invention, a plurality of detachable high velocity modules are positioned end to end, lengthwise in the hood.

According to yet another preferred embodiment of the invention, a relatively shallow grease tray is located beneath the high velocity module and adjacent to the back wall of the hood for capturing grease removed from the air stream as the air stream is pulled through the filter. The grease tray extends from one side wall of the hood to the other side wall of the hood.

According to yet another preferred embodiment of the invention, the grease tray declines from an upper first end to a lower second end for allowing the grease to flow downstream towards the second end. The second end includes a relatively small opening for permitting the grease to drain out of the grease tray.

According to yet another preferred embodiment of the invention, a detachable grease cup is located beneath the opening of the second end for collecting grease as the grease drains from the grease tray.

According to yet another preferred embodiment of the invention, a flue gas bypass is located in back of the cooking unit and adjacent to the back wall of the hood. The bypass comprises an upwardly extending chamber in communication with the air duct for moving flue gases emitted from a gas powered cooking unit from the cooking area to the atmosphere.

An embodiment of the method of removing kitchen exhaust fumes entrained in a moving air stream from an area surrounding a cooking unit comprises the steps of mounting a blower outside of the cooking area and in communication with the atmosphere for moving air from the cooking area to the atmosphere. An overhanging hood is placed above the cooking unit and in communication with the blower for pulling air upwardly through a ventilation opening defined by the hood. A high velocity module is provided for being placed in the ventilation opening. The high velocity module is removably attached to the hood. Air flow is accelerated into the high velocity module. Grease is then filtered from the air stream as the air stream is passed through the high velocity module.

According to one preferred embodiment of the invention, the step of providing a high velocity module further includes forming a filter housing in the high velocity module for carrying a filter, and connecting an inclined exhaust baffle to respective side plates of the high velocity module between the filter housing and the cooking unit for accelerating air flow from the cooking area through the high velocity module.

According to another preferred embodiment of the invention, the step of removable attaching the high velocity module to the hood includes supporting a front end of the high velocity module by a support shelf extending inwardly from a front wall of the hood, and mounting a back end of the high velocity module on a support ledge connected to a back wall of the hood.

According to yet another preferred embodiment of the invention, the step of accelerating air flow into the high velocity module comprises forming at least one laterally extending slot in the baffle and directing air flow therethrough.

According to yet another preferred embodiment of the invention, the step of filtering grease from the air stream as the air stream is passed through the high velocity module includes inserting a filter into the filter housing and directing the inward flow of air from the baffle through the filter.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
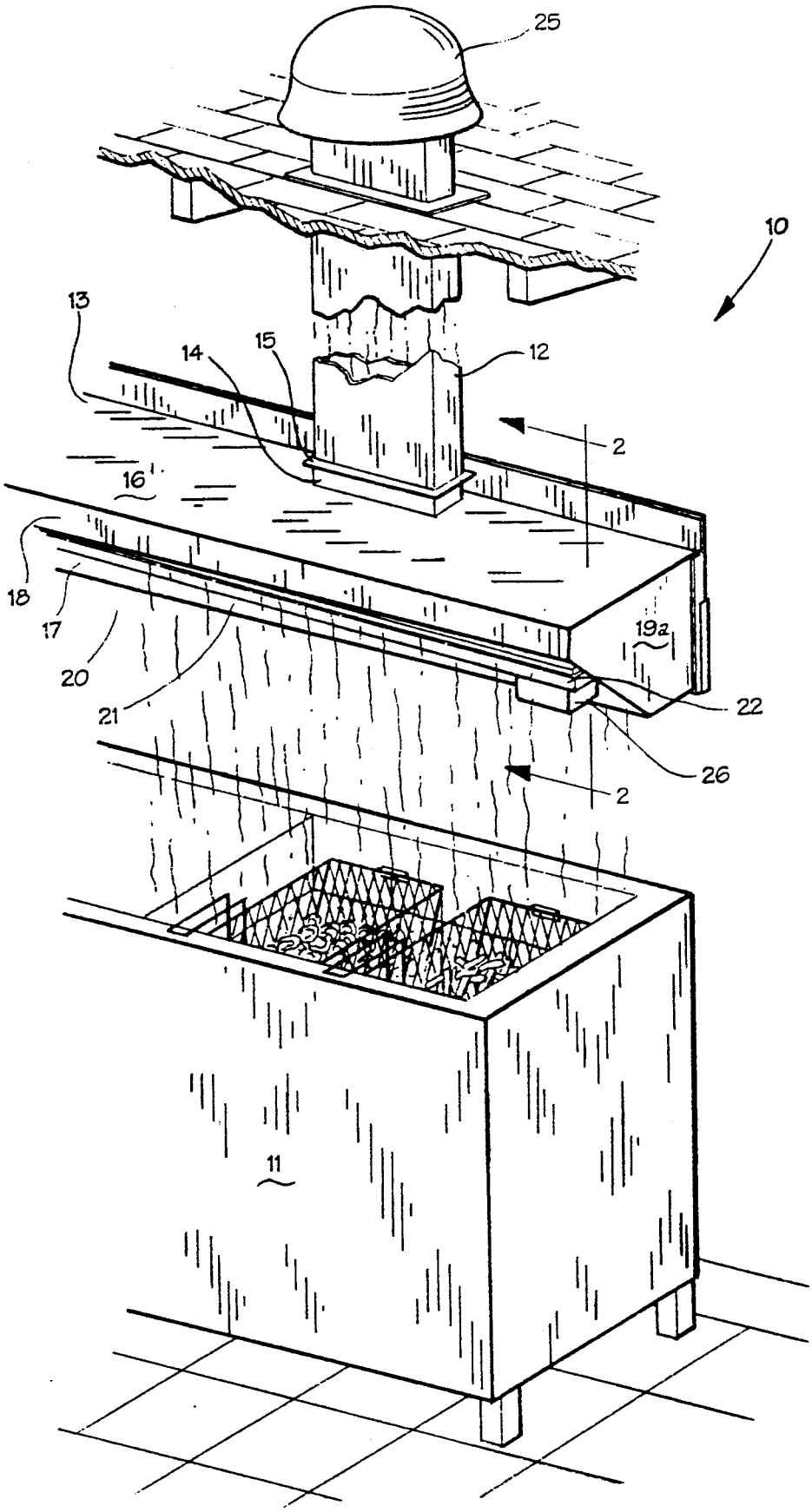
FIG. 1 is a perspective view of the invention illustrating the location of various elements in a kitchen area of a restaurant.

Referring now specifically to the drawings, a ventilator assembly according to the present invention is illustrated in FIG. 1 and shown broadly at reference numeral 10. The ventilator assembly 10 is designed to be mounted in a kitchen or cooking area, usually above a cooking unit 11, such as a deep fryer. As shown in FIG. 1, the invention removes exhaust fumes emitted from the cooking unit 11 by entraining the fumes in a moving air stream and drawing the air stream upwardly away from the cooking area, then filtering the air stream to remove the fumes, and finally passing the filtered air through an air duct 12 to the atmosphere outside of the building or restaurant.

A hood 13 is positioned above the cooking unit 11, and includes a top wall 16, a back wall 17, front wall 18 and spaced apart opposing side walls 19*a* and 19*b*. The walls 16, 17, and 19*a–b*, define a ventilation opening 20 through which kitchen air is pulled. A removable high velocity module 21 is attached in the ventilation opening 20 of the hood 13, and includes a means for accelerating air flow from the cooking area through the ventilation opening 20.

Figure 4:
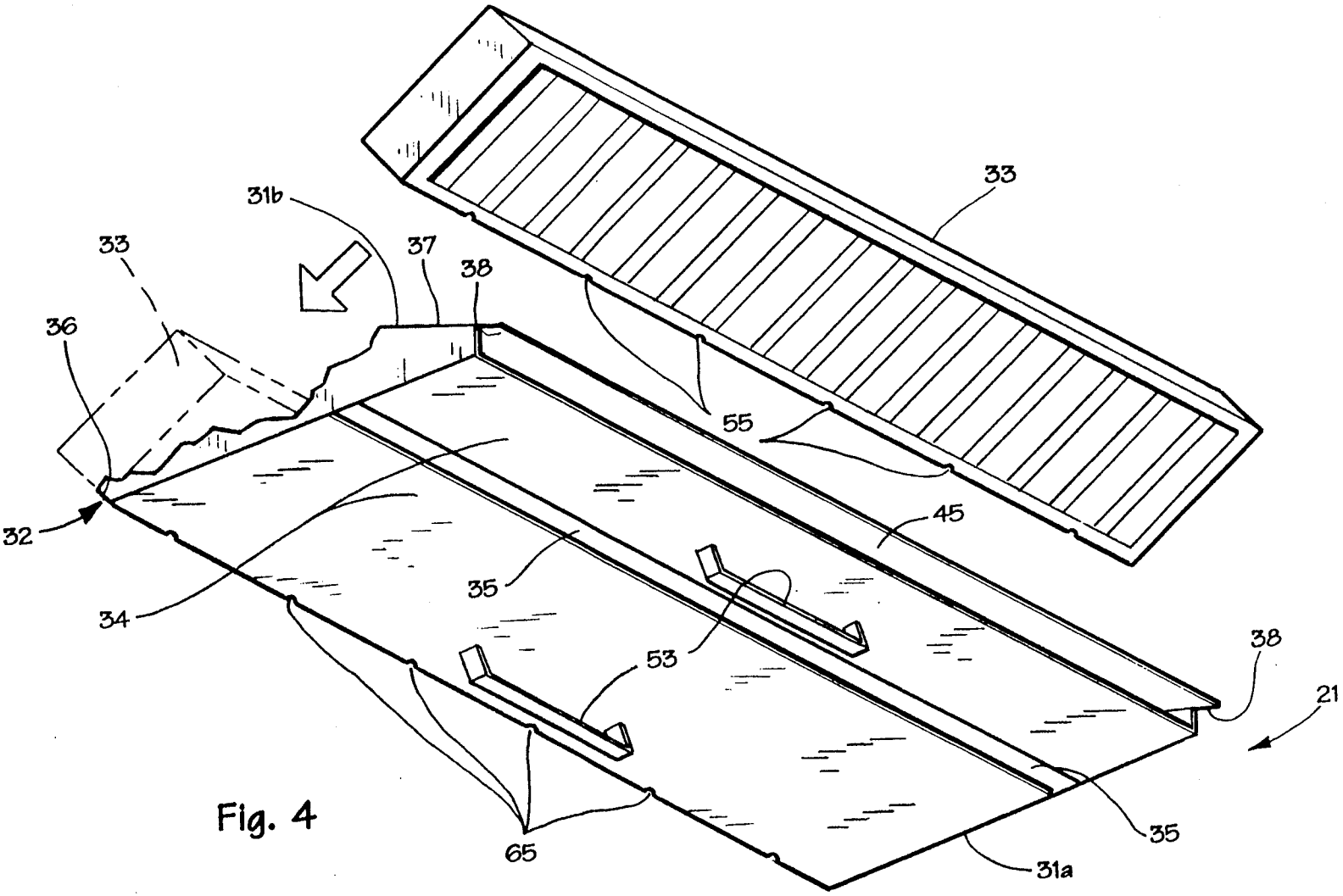
FIG. 4 is a perspective view of the high velocity module showing the filter removed from the high velocity module.

As shown in FIG. 4, the high velocity module 21 includes a filter 33 for filtering grease contaminants from the surrounding air stream as the air stream is passed upwardly through the ventilation opening 20. A grease tray 22 and cup 26 are located beneath the high velocity module 21 for collecting grease filtered out from the high velocity module 21. Each of these and other elements, as employed in the process for removing exhaust fumes entrained in a moving air stream from the cooking area, are described in detail below.

Referring again to FIG. 1, a blower 25 is mounted outside of the restaurant and typically on the roof of the restaurant. The blower 25 communicates with the air duct 12 which runs downwardly from the blower 25 to an area inside the kitchen and above the hood 13 and cooking unit 11. The air duct 12 connects to an air vent 14 formed in the top wall 16 of the hood 13. Preferably, a vent collar 15 acts to seal the engagement of the air duct 12 and vent 14, thereby creating a sealed channel for air passage. The blower 25 creates a low-pressure area to draw air from the cooking area, through the high velocity module 21, and through the duct 12 to the atmosphere outside of the restaurant. The kitchen air and exhaust fumes are accelerated and filtered through the high velocity module 21. Thus, the high velocity module 21 serves to remove grease contaminants from the air stream before dispersal to the atmosphere, and to increase the velocity of air flow through the ventilation opening 20. The increased air velocity provides greater fume removal from the immediate cooking area, without removing the conditioned air of the kitchen.

Description of the Hood

Figure 2:
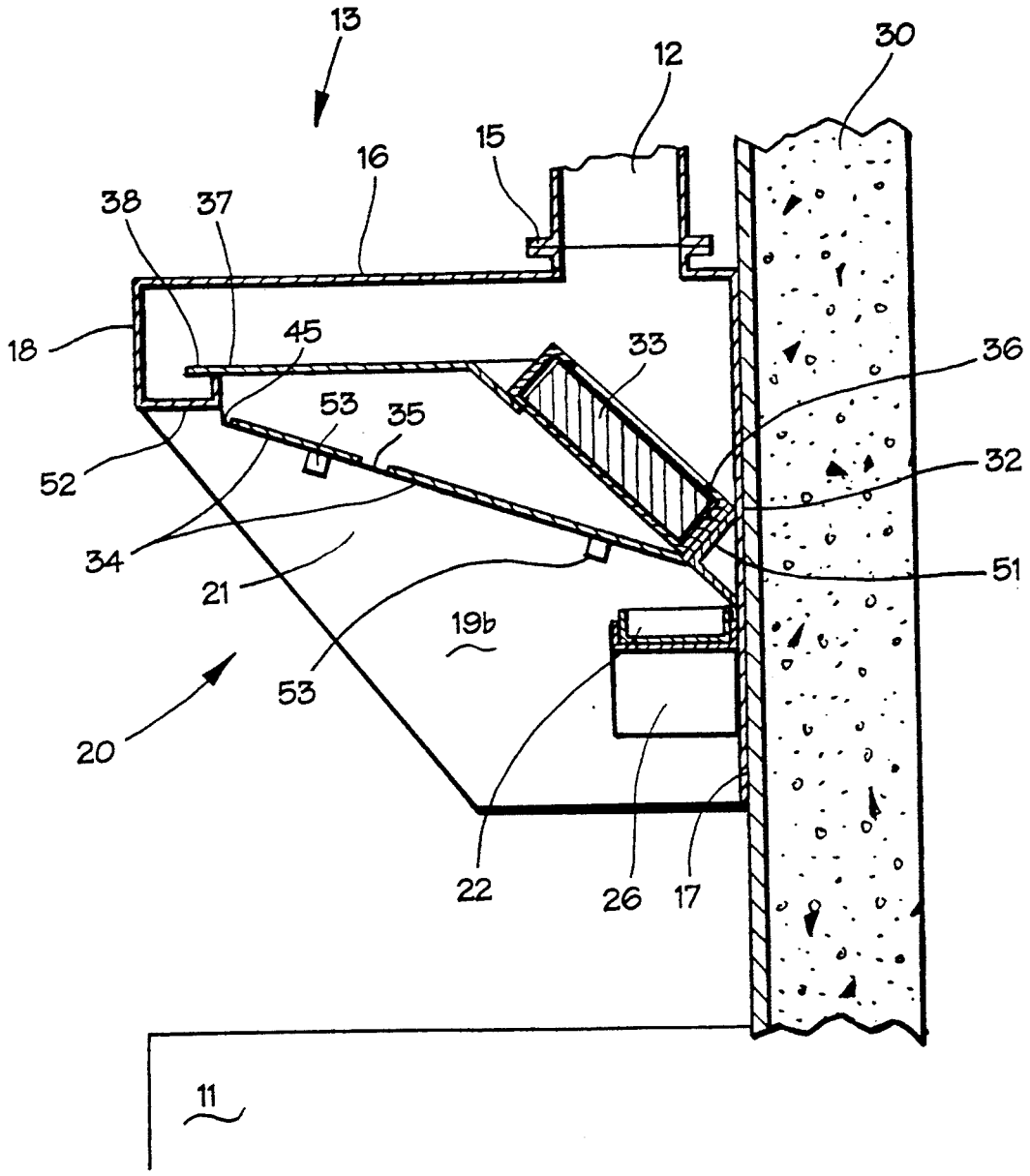
FIG. 2 is a cross-sectional side view of the invention illustrated in FIG. 1 taken substantially along the line 2—2.
Figure 3:
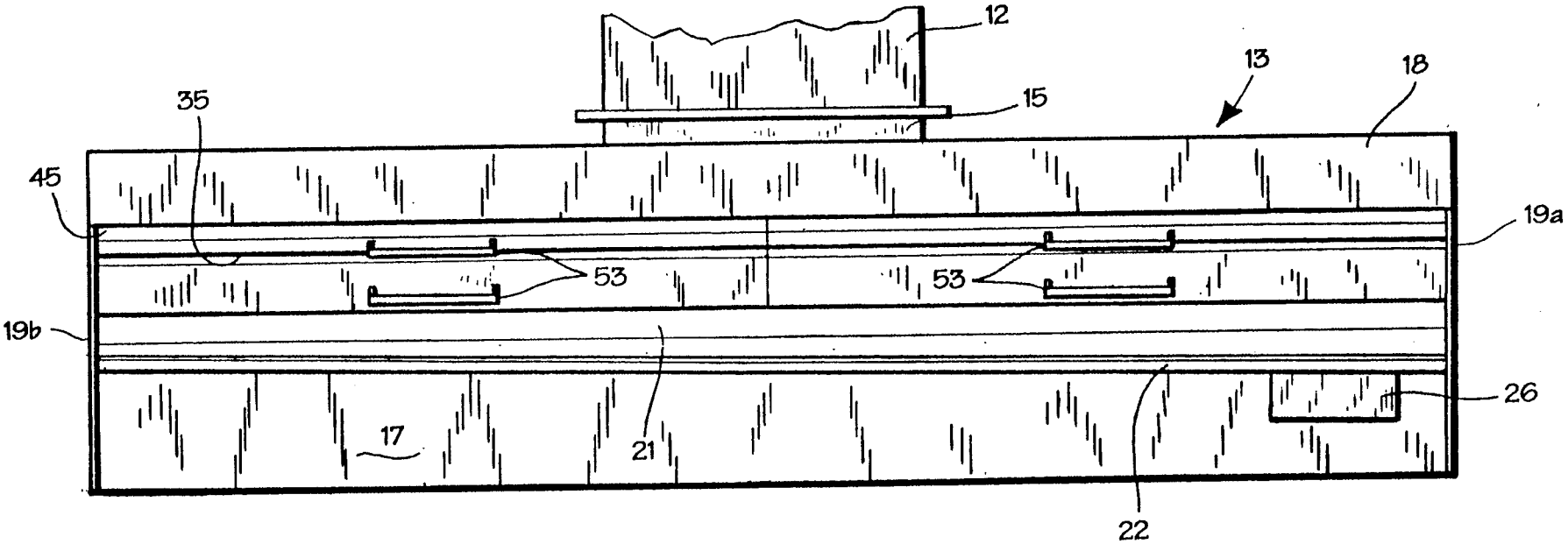
FIG. 3 is a front elevation of the invention showing the high velocity module positioned within the ventilation opening defined by the hood.

Referring now to FIGS. 2 and 3, the hood 13 and high velocity module 21 are illustrated with the high velocity module 21 in its attached position within the ventilation opening 20 of the hood 13. The hood 13 is attached to a wall 30 of the kitchen above the cooking unit 11 by a plurality of bolts, screws, weld, or any other suitable attachment means. The hood 13 may be constructed of stainless steel with a No. 3 polish. Preferably, the hood 13 is spaced 2–4 feet above the cooking unit 11. The top wall 16 of the hood 13 extends outwardly from the kitchen wall 30 approximately 14 inches, and the back wall 17 extends downwardly from a back edge of the top wall 16 approximately 12 inches. Additionally, the front wall 18 extends approximately 3 inches downwardly from a front edge of the top wall 16, and the side walls 19*a–b* extend respectively from the back wall 17 approximately 6 inches before gradually tapering to the front wall 18. Note, however, that the hood 13 may be of any suitable dimension to accommodate a given-sized cooking unit.

Description of the High Velocity Module

Figure 5:
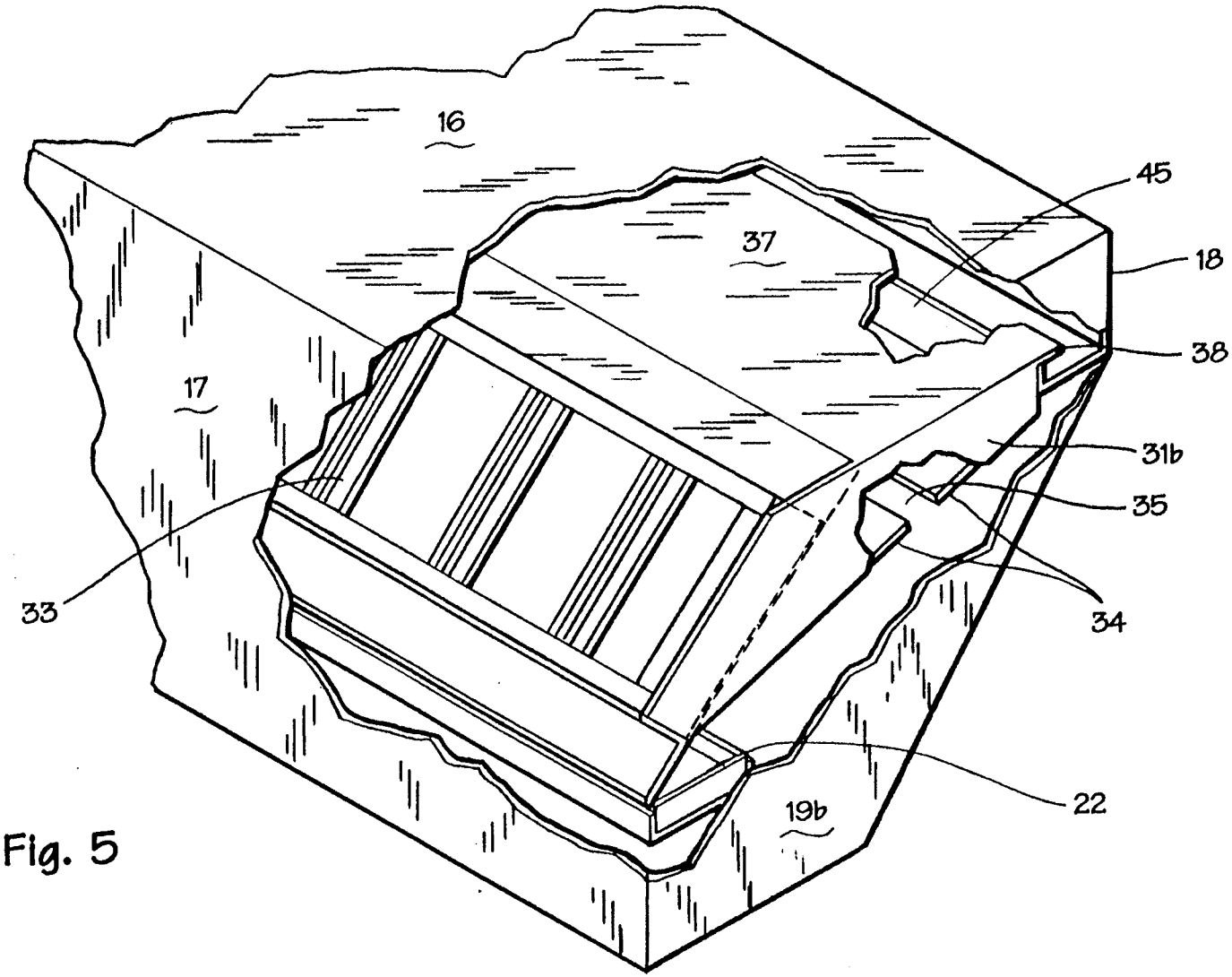
FIG. 5 is a back perspective view of the hood with wall portions broken away to show the high velocity module positioned within the ventilation opening defined by the hood.

As illustrated in FIGS. 4 and 5, the high velocity module 21 includes opposing side plates 31*a* and 31*b*, a filter housing 32 and replaceable filter 33, and an inclined exhaust baffle 34 having at least one laterally extending slot 35 formed therein. When the high velocity module 21 is placed in the ventilation opening 20 and attached to the hood 13, the baffle 34 extends inwardly and downwardly in a diagonal line from the front wall 18 of the hood 13 to the back wall 17 of the hood 13 (See FIG. 2). The baffle 34 and filter housing 32 are described in detail below.

Referring to FIGS. 2 and 4, the baffle 34 is positioned between the filter housing 32 and the cooking unit 11 at about a 30 degree angle with respect to the cooking unit 11. Preferably, the baffle 34 extends along the entire length of the high velocity module 21 and substantially encompasses the entire ventilation opening 20. The slot 35 extends laterally from one side of the baffle 34 to the other side, and is approximately one inch wide. Preferably, the slot 35 is located generally in the middle of the baffle 34. By positioning the baffle 34 at an angle with respect to the cooking unit 11, the surrounding air stream is more effectively directed through the slot 35 and filter 33. The slot 35 operates to accelerate the air flow into the high velocity module 21, thereby requiring less blower energy for transporting the fumes from the kitchen. Moreover, because of the increased velocity and decreased blower energy, less surrounding conditioned air is removed from the kitchen area. This results in more cost efficient heating and cooling of the area. Additional slots may be formed-in the baffle 34 for achieving a similar high velocity effect.

The filter housing 32, according to one embodiment, includes a base plate 36 connected to a back edge of the baffle 34 for carrying the filter 33. The base plate 36 supports the filter 33 and extends at an obtuse angle from the planar surface of the baffle 34, approximately 95–110 degrees. In one embodiment, the base plate 36 extends from the back edge of the baffle 34 approximately 2–4 inches. According to another embodiment, the filter housing 32 does not include a base plate 36, but instead is supported against the back wall 17 of the hood 13 when the high velocity module 21 is positioned within the ventilation opening 20.

The high velocity module 21 further includes a top plate 37 connected to the side plates 31*a–b*. The top plate 37 extends from the front end of the high velocity module 21 to the back end of the high velocity module 21 in a substantially parallel plane with respect to the top wall 16 of the hood 13. The top plate 37 is designed to abut the top of the filter 33 when the filter 33 is placed in the filter housing 32. This will ensure filtering of the air stream by preventing air moving through the slot 35 from escaping over the top of the filter 33.

The top plate 37 includes an integrally formed lip 38 located on a front edge of the top plate 37 at the front end of the high velocity module 21. Preferably, the lip 38 extends laterally along the entire length of the module 21, and beyond the front end of the high velocity module 21 approximately one inch.

A second slot 45, approximately one inch wide, is formed between the front edge of the top plate 37 and the front edge of the baffle 34. The second slot 45 is located upstream of the first slot 35, and at the front end of the high velocity module 21. This slot 45 serves to catch fumes which may have avoided being captured by the first slot 35, thus preventing fumes from rolling over the front end of the hood 13.

Attachment Means

As previously discussed, the high velocity module 21 is removable attached to the hood 13. As best shown in FIG. 2, front and back support means of the hood 13 act to support the respective front and back ends of the high velocity module 21 within the ventilation opening 20.

A support ledge 51 formed to the back wall 17 of the hood 13 supports the back end of the high velocity module 21. According to one embodiment, the support ledge 51 comprises an integrally formed member laterally extending along the back wall 17 of the hood 13, and extending substantially the entire length of the high velocity module 21. In another embodiment (not shown), the support ledge 51 includes at least one outwardly extending reverse angle bracket bolted to the back wall 17 of the hood 13 for engaging the back end of the high velocity module 21. Preferably, the base plate 36 of the filter housing 32 rests unattached atop the support ledge 51.

An inwardly extending support shelf 52 located on the inside surface of the front wall 18 supports the front end of the high velocity module 21. Preferably, the support self 52 comprises an integrally formed member that extends substantially along the entire length of the front wall 18 at a bottom edge of the front wall 18. Alternately, the support shelf 52 comprises at least one angle bracket attached to and extending from the inside surface of the front wall 18. Preferably, the lip 38 of the top plate 37 of the high velocity module 21 engages the shelf 52 for supporting the front end of the high velocity module 21. According to another embodiment (not shown), the front edge of the baffle 34 engages the shelf 52 for supporting the front end of the high velocity module 21.

Preferably, at least one handle 53 is attached to the exterior surface of the baffle 34 by a weld or other suitable connection means. The handle 53 serves to provide a convenient means for inserting and removing the high velocity module 21 from the hood 13.

Filtering the Air Stream

The roof-top blower 25, shown in FIG. 1, operates to pull or draw air from the kitchen, pass it through the high velocity module 21 located above the cooking unit 11, and then through the air duct 12 for dispersion to the atmosphere. When in position within the ventilation opening 20 of the hood 13 as described above, the high velocity module 21 operates to accelerate air flow through the baffle 34 at slots 35 and 45, and then filter the air to remove grease contaminants entrained therein.

As best shown in FIG. 4, the filter 33 includes a number of weep holes 55 formed at a bottom edge of the filter 33 for allowing collected grease to dispense from the filter 33. The lower edge of the high velocity module 21, at the connection of the base plate 36 and baffle 34, includes corresponding weep holes 65 for allowing grease from the filter 33 to pass through the high velocity module 21.

As shown in FIGS. 1, 2, and 3, the relatively shallow grease tray 22 is located beneath the high velocity module 21, and extends laterally from one end of the hood 13 to the other end of the hood 13. The grease tray 22 is attached to the back wall 17 of the hood 13 by any suitable weld, bolt or screw connection. The grease tray 22 serves to capture grease from the high velocity module weep holes 65, and to prevent the grease from dropping onto the hot surface of the cooking unit.

To prevent grease from accumulating in the grease tray 22, the tray 22 is preferably inclined or sloped from one end of the hood 13 to the opposite end of the hood 13. A small hole is located at the downstream end of the tray 22 with the cup 26 removable attached directly below. The cup 26 acts to collect the grease as it runs downwardly and drains from the hole.

Alternate Embodiments

A ventilator assembly including a hood, high velocity module and filter has been described above. The assembly may include any desired length of hood to accommodate a given-sized cooking unit. Typical hood lengths are illustrated in FIGS. 6 and 7; a 48 inch (122 cm) hood 83 and 120 inch (305 cm) hood 93, respectively.

Figure 6:
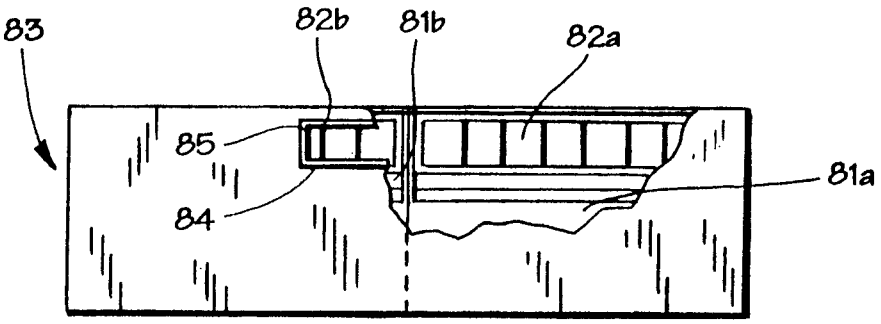
FIG. 6 is a top plan view of the invention with parts broken away, according to one preferred embodiment of the invention.

The 48 inch hood 83 shown in FIG. 6 is designed to house two high velocity modules 81*a* and 81*b* positioned end to end, lengthwise, for moving and filtering the surrounding air stream at a general rate of 420 cubic feet per minute (CFM). Preferably, each high velocity module 81*a–b* includes a respective filter 82*a* and 82*b* approximately 6 inches high, 24 inches long, and 2 inches wide (6"×24"×2"). The 48 inch hood 83 includes one air vent 84 formed in the top wall of the hood 83, and one vent collar 85 approximately 10 inches long and 3 inches wide (10"×3").

Figure 7:
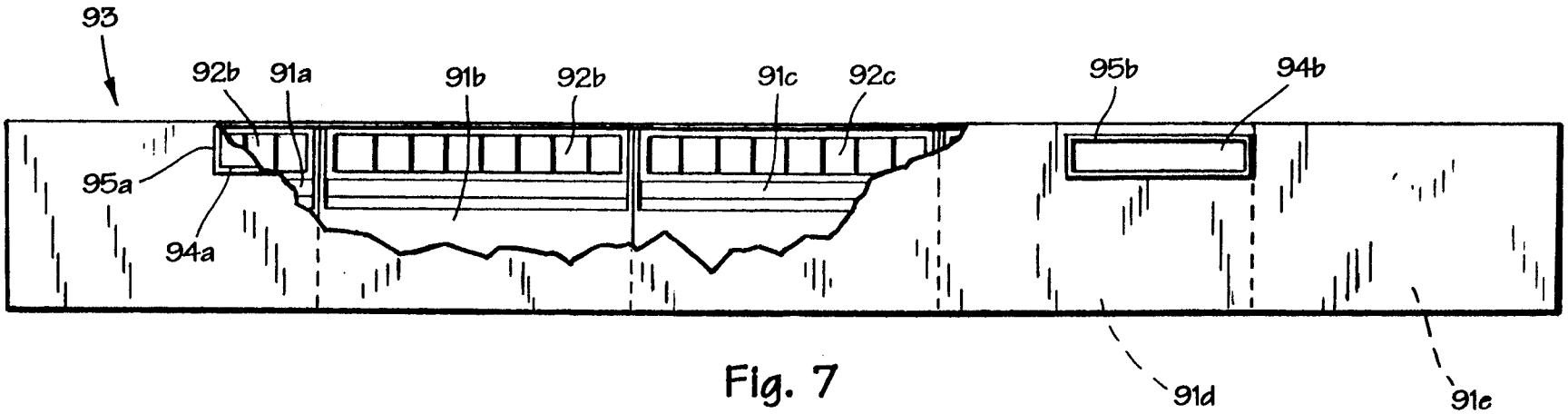
FIG. 7 is a top plan view of the invention with parts broken away, according to a second preferred embodiment of the invention.

The 120 inch hood 93 shown in FIG. 7 is designed to house five high velocity modules 91*a–e* including five respective filters 92*a–e*. The filters 92 of this embodiment are approximately 6"×24"×2". Preferably, two spaced-apart air vents 94*a* and 94*b*, including respective 12"×3" vent collars 95*a* and 95*b*, are formed in the top wall of the hood 93 in communication with the air duct. A hood 93 of this length is designed to move and filter the air stream at about 1050 CFM.

Other sized hoods (not shown) such as a 60 inch, 84 inch, or 108 inch, may be constructed with a desired number of high velocity modules and filters for removing fumes from any given kitchen area.

Figure 8:
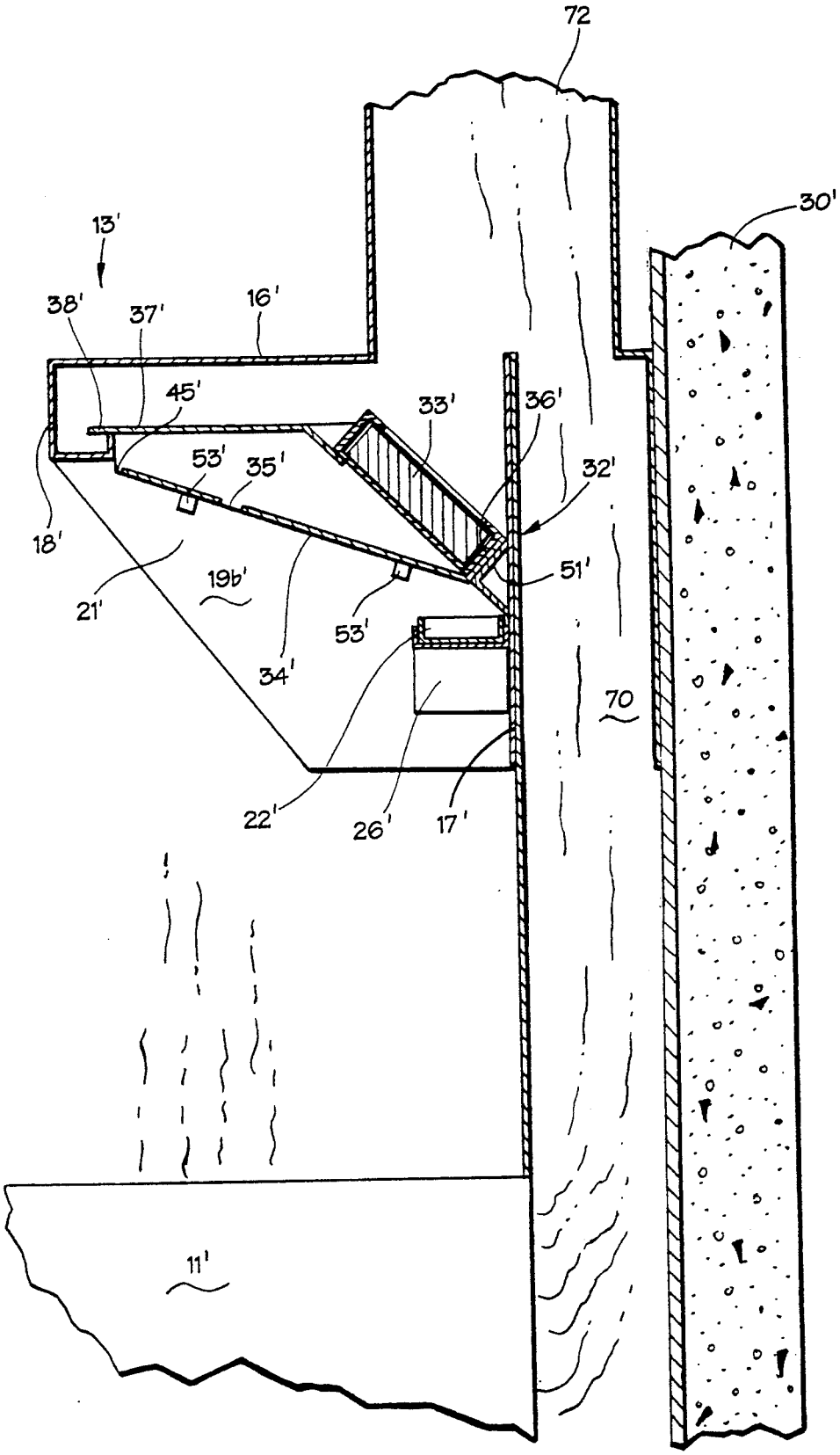
FIG. 8 is a cross-sectional side view of the invention illustrating the flue gas by-pass.

For gas-powered cooking units, a flue gas by-pass 70 shown in FIG. 8 may be constructed for simultaneously removing flue gas and exhaust fumes from the cooking area. The ventilator assembly with flue gas by-pass 70 includes many of the elements described above with reference to FIGS. 1–5. These elements are indicated in prime notation in FIG. 8 to signify identical features and operation according to this embodiment.

The by-pass 70 comprises a chamber located adjacent to and behind the cooking unit 11', and extending upwardly from the cooking unit 11' to the air duct 72. The flue gas emitted from the cooking unit 11' does not pass through the high velocity module 21', but instead goes directly to the air duct 72 for discharge to the atmosphere.

A ventilator assembly according to the-present invention is described above. Various details of the invention may be changed without departing from its scope. Furthermore, the foregoing description of the preferred embodiment of the invention and the best mode for practicing the invention are provided for the purpose of illustration only and not for the purpose of limitation-the invention being defined by the claims.

I claim:

1. A ventilator assembly for removing kitchen exhaust fumes entrained in a moving air stream from an area surrounding a cooking unit, and including a roof-top blower for moving the air stream from the cooking area through an air duct to the atmosphere, said ventilator assembly comprising:

(a) an overhanging hood defining a ventilation opening located above said cooking unit, said hood including a back wall, an outwardly extending top wall, a front wall, and spaced-apart opposing side walls;

(b) one or more air vents formed in the top wall of said hood and in communication with said air duct;

(c) a detachable high velocity module positioned in said hood in filtering relation to said one or more air vents, said high velocity module including opposing side plates, a filter housing means connected to said side plates, and an inclined exhaust baffle located between said filter housing means and said cooking unit; said exhaust baffle being positioned in the ventilation opening of said hood and extending inwardly and downwardly in a diagonal line from the front wall of said hood to the back wall of said hood, said exhaust baffle defining at least one laterally extending slot formed therein for accelerating the flow of the moving air stream into said high velocity module; and (d) one or more grease filters mounted in said filter housing means for removing fumes from the moving air stream as the fumes are pulled upwardly in the air stream by said roof-top blower away from the cooking area and through the high velocity module from an upstream side to an downstream side thereof.

2. A ventilator assembly according to claim 1, wherein said back wall includes a support ledge connected thereon for supporting a back end of said high velocity module, and said front wall includes an inwardly extending shelf connected thereto for supporting a front end of said high velocity module.

3. A ventilator assembly according to claim 2, wherein the filter housing means of said high velocity module includes a base plate extending from a back edge of said baffle at an obtuse angle with respect to said baffle, said base plate designed for carrying said filter and for engaging the support ledge of said back wall.

4. A ventilator assembly according to claim 3, wherein said high velocity module further includes a top plate connected to said side plates for extending in a substantially horizontal plane opposite said baffle, said top plate having a support lip connected thereto extending beyond the front end of said high velocity module for engaging the self of said front wall.

5. A ventilator assembly according to claim 4, wherein said filter is mounted on the base plate of said filter housing and extends upwardly and outwardly in a diagonal line to a back edge of said top plate.

6. A ventilator assembly according to claim 5, wherein said top plate and a front edge of said baffle define a slot formed therebetween extending from one side plate to the other side plate for accelerating air flow into said high velocity module.

7. A ventilator assembly according to claim 6, wherein said filter includes a plurality of weep holes formed in the base thereof for allowing filtered grease to weep out of the filter.

8. A ventilator assembly according to claim 7, wherein the back edge of said baffle and the base plate are integrally formed, and include a plurality of weep holes formed at said connection substantially corresponding to and in cooperation with the weep holes of said filter for allowing the grease from said filter to weep out of said high velocity module.

9. A ventilator assembly according to claim 8, further comprising at least one handle connected to an exterior face of said baffle for allowing said high velocity module to be easily inserted into and detached from said hood.

10. A ventilator assembly according to claim 1, wherein said ventilator assembly includes a plurality of detachable high velocity modules positioned end to end, lengthwise in said hood.

11. A ventilator assembly according to claim 1, further comprising a relatively shallow grease tray located beneath said high velocity module and adjacent to the back wall of said hood for capturing grease removed from the air stream as the air stream is pulled through said filter, said grease tray extending from one side wall of said hood to the other side wall of said hood.

12. A ventilator assembly according to claim 11, wherein said grease tray declines from an upper first end to a lower second end for allowing the grease to flow downstream towards said second end, and said second end including a relatively small opening for permitting the grease to drain out of said grease tray.

13. A ventilator assembly according to claim 12, further comprising a detachable grease cup located beneath the opening of said second end for collecting grease as said grease drains from said grease tray.

14. A ventilator assembly according to claim 1, further comprising a flue gas bypass located in back of said cooking unit and adjacent to the back wall of said hood, said bypass comprising an upwardly extending chamber in communication with said air duct for moving flue gases emitted from a gas powered cooking unit from the cooking area to the atmosphere.

15. A method of removing kitchen exhaust fumes entrained in a moving air stream from an area surrounding a cooking unit, comprising the steps of:

(a) mounting a blower outside of the cooking area and in communication with the atmosphere for moving air from the cooking area to the atmosphere;

(b) placing an overhanging hood above said cooking unit and in communication with said blower for pulling air upwardly through a ventilation opening defined by said hood;

(c) providing a high velocity module for being placed in said ventilation opening;

(d) removable attaching said high velocity module to said hood;

(e) accelerating air flow into said high velocity module; and (f) filtering grease from the air stream as the air stream is passed through said high velocity module.

16. A method of removing kitchen exhaust fumes according to claim 15, wherein the step of providing a high velocity module further includes forming a filter housing means in said high velocity module for carrying a filter, and connecting an inclined exhaust baffle to respective side plates of said high velocity module forward of said filter housing means and in fume-engaging relation to said cooking unit for accelerating air flow from the cooking area through the high velocity module.

17. A method of removing kitchen exhaust fumes according to claim 16, wherein the step of removable attaching said high velocity module to said hood comprises supporting a front end of said high velocity module by a support shelf extending inwardly from a front wall of said hood, and mounting a back end of said high velocity module on a support ledge connected to a back wall of said hood.

18. A method of removing kitchen exhaust fumes according to claim 17, wherein the step of accelerating air flow into said high velocity module comprises forming at least one laterally extending slot in said baffle and directing air flow therethrough.

19. A method of removing kitchen exhaust fumes according to claim 18, wherein the step of filtering grease from the air stream as the air stream is passed through said high velocity module comprises inserting a filter into said filter housing means and directing the inward flow of air from said baffle through said filter.

* * * * *